United States Patent [19]

Schwartz et al.

[11] Patent Number: 5,010,751

[45] Date of Patent: Apr. 30, 1991

[54] SAFE DEVICE AND MECHANISM FOR OPERATING THE SAME

[75] Inventors: Moshe Schwartz; Noam Avni, both of Kibutz Hatzor, Israel

[73] Assignee: Omen Metal Products, Israel

[21] Appl. No.: 304,944

[22] Filed: Jan. 31, 1989

[30] Foreign Application Priority Data

Feb. 3, 1988 [IL] Israel ..... 85307
Dec. 2, 1988 [IL] Israel ..... 88567

[51] Int. Cl.[5] ..... E05B 47/06
[52] U.S. Cl. ..... 70/276; 70/279; 340/825.31
[58] Field of Search ..... 70/279, 278, 276; 340/825.31

[56] References Cited

U.S. PATENT DOCUMENTS

| | | | |
|---|---|---|---|
| 2,073,523 | 3/1937 | Meilink | 70/272 |
| 4,372,419 | 2/1983 | Barnett et al. | 70/279 X |
| 4,534,194 | 8/1985 | Aydin | 70/278 |
| 4,665,727 | 5/1987 | Uyeda | 70/279 |
| 4,671,086 | 6/1987 | Fogleman et al. | 70/279 X |
| 4,691,542 | 9/1987 | Young | 70/279 X |
| 4,742,426 | 5/1988 | Lavelle | 340/825.31 |
| 4,749,991 | 6/1988 | Davis et al. | 340/825.31 |

FOREIGN PATENT DOCUMENTS 0152678 8/1985 European Pat. Off. .

*Primary Examiner*—Lloyd A. Gall

*Attorney, Agent, or Firm*—Kane, Dalsimer, Sullivan, Kurucz, Levy, Eisele and Richard

[57] ABSTRACT

The invention relates to a magnetic-card operated mechanism for closing and opening safes and to safes embodying it. The mechanism is powered by batteries and comprises means for reading a magnetic card, an electronic activating circuit and a locking mechanism, and is provided with electronic means for permanently storing information, with means for changing the power drawn from the batteries between at least one high level and one low level, with means for checking the correctness of the card code and of its reading, and with means for enabling the card to actuate the mechanism only if the result of the check is positive. The mechanism comprises an electrically actuated locking device powered by an electric motor and may also comprise additional manual locking means, which are blocked in the locking position or are released therefrom by the electrically actuated device. The said high power level corresponds to the power required by the electric motor and any other accessory devices, while said low power level corresponds to the tension required to prevent erasure of information contained in the volatile memories that are part of the electronic activating circuit. This assures a life-period in the order of a number of years between battery changes. An emergency unlocking device is provided, to permit opening the safe in case of failure of the normal unlocking means, said emergency device being enclosed in the safe door and only operative if it is manually actuated through a perforation in said door.

10 Claims, 7 Drawing Sheets

SAFE DEVICE AND MECHANISM FOR OPERATING THE SAME

BACKGROUND OF THE INVENTION

1. Field of Invention

The present invention relates to safes and mechanisms for operating them. More particularly it relates to safes that are intended successively to be used at short intervals by different persons, such as the safes which are located in hotel rooms for the convenience of the guests.

2. Description of the Prior Art

Safes of this kind that are actuated by means of magnetic cards, such as credit cards, are known in the art. However the known safes have a number of drawbacks. For instance, they are intended to be powered from a power line, batteries being provided merely for emergency and having, when so used, only a limited life, in the order of 100 days or slightly more. This constitutes a disadvantage in hotel rooms in which several electrical appliances are already located and limits the possibility of placing the safe where one wishes. Further, it is customary to provide the user with a special card which is employed to operate the safe, and the user cannot employ any magnetic card he possesses. Still further, known safes are not adequately protected against malfunctions, which may cause great inconvenience to the user. One of such malfunctions may derive from a defect in the magnetic code of the card employed or its reading by the magnetic card reader. Still further, the electrically operating locking mechanisms of the known safes do not afford adequate protection against braking in.

SUMMARY OF THE INVENTION

It is an object of this invention to overcome all the aforesaid and other drawbacks of known card-operated safes. In particular, it is an object of the invention to provide a safe, the operating mechanism whereof is battery-powered and yet assures a long life-period between battery changes, in the order of a number of years. Of course, in order to obtain a long life-period between battery changes, it is necessary to employ batteries whose normal shelf life is not too short. Alkaline batteries, whose normal shelf life is about at least five years, will provide a similarly long life-period.

Its is a further object of the invention to provide a safe, the locking mechanism whereof will be enabled to operate only after it has been checked that the magnetic card is not defective and has been properly read.

It is a still further object to provide a safe, the locking mechanism whereof is particularly strong and proof against breaking-in.

It is still a further object to provide a safe of the kind described, which is inexpensive to make and easy and safe to operate and that is adequately protected against possible malfunctions and failures.

It is a still further object to provide a safe of the kind described, which is provided with an emergency unlocking mechanism, to permit opening of the safe in case of failure of the normal opening mechanism.

Other objects of the invention will appear as the description proceeds.

The safe according to the invention is characterized in that it comprises, in combination with a safe structure, with a battery as a source of power, with means for reading a magnetic card, with an electronic activating circuit, and with a locking mechanism, electronic means for permanently storing information, means for changing the power drawn from a power source, between at least one high level and one low level, means for checking the correctness of the code of the card and of its reading, and means for enabling the card to actuate the opening or closing of the safe door only if the result of said check is positive.

According to a preferred embodiment of the invention, the electronic means for permanently storing information comprise at least an EPROM external to the electronic activating circuit.

According to a further preferred form of the invention, the means for changing the power drawn from the power sources operates between a high level, corresponding to the power required by the electric motor and other accessory devices, and a low level, corresponding to the tension required to prevent erasure of information contained in the volatile memory or memories that are part of the electronic activating circuit, such as a RAM. In general the high level corresponds to a current in the order of 150 mA, and the low level to a current in the order of 1 $\mu$A.

According to a still further preferred form of the invention, the means for checking the correctness of the code and of its reading and for enabling the card to actuate the opening or closing of the safe if the check is positive, comprise a RAM or the like included in the electronic activating circuits, which has therein at least one temporary buffer memory segment and one buffer card location, the magnetic card code being introduced into the temporary buffer location and checked therein and transferred to the card buffer location after the check has been completed.

According to a preferred embodiment of the invention, the locking mechanism comprises a hand-operated lock which is mounted on the safe door and engages the safe body, strongly to lock the first on the second, and an electrically operated lock, also mounted on the safe door, and engaging a part of the manually operated lock, to prevent this latter from being manually displaced to the unlocked position, whenever the safe is to remain locked.

According to a further preferred embodiment of the invention, the safe is provided with an improved emergency unlocking mechanism, which comprises, in combination with a support fixed to a structural element of the safe, generally the safe door, and a base plate, on which the electric lock is mounted and which is slidably mounted on said structural element for limited rectilinear displacement between the forward and the rear position of the electric lock, an eccentric rotatably mounted on said support and engaging an element of said base plate, whereby rotation of said eccentric will cause said rectilinear displacement of said base plate, said eccentric being so mounted that it may freely rotate in such a direction as to displace said base plate from the rear to the forward position and may additionally rotate only by a small angle in the same direction.

Preferably, after said additional rotation said eccentric will bear against a portion of said base plate and be prevented thereby from further rotating in the same direction.

Other preferred and optional features of the invention will appear from the description of a preferred embodiment, with reference to the attached drawings, wherein:

DESCRIPTION OF THE PREFERRED EMBODIMENTS

With reference now to the drawings, numeral 10 generally designates the safe body, and numeral 11 the safe door. This latter has mounted thereon the magnetic card-reader 12 and a handle 13, which serves to operate a manually actuated lock, whenever this is provided (as in the embodiment of FIG. 2).

Figure 1:
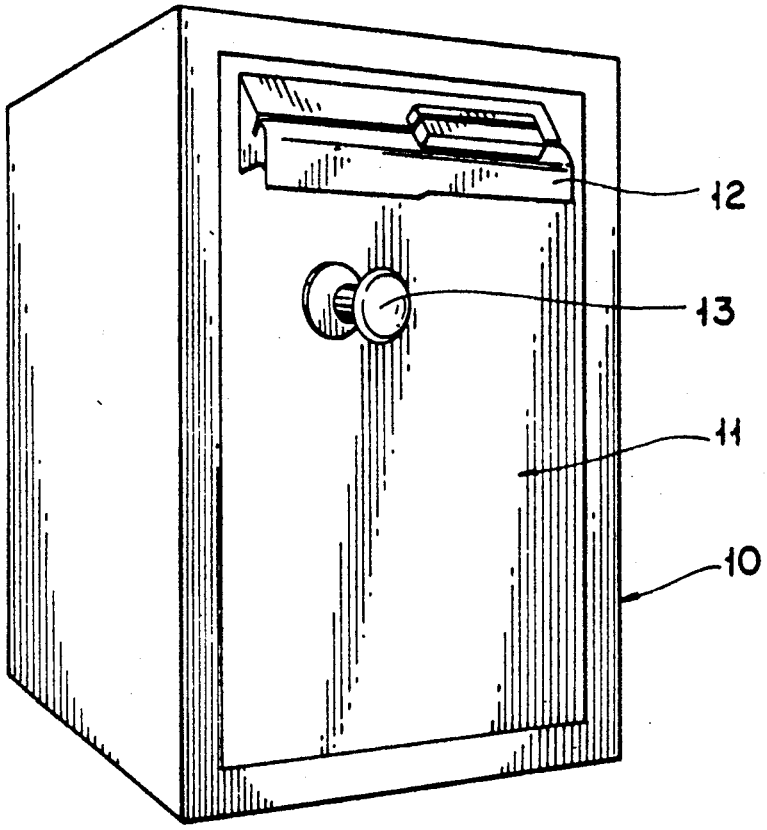
FIG. 1 is a perspective view of the safe according to one embodiment of the invention, seen from the front.
Figure 2:
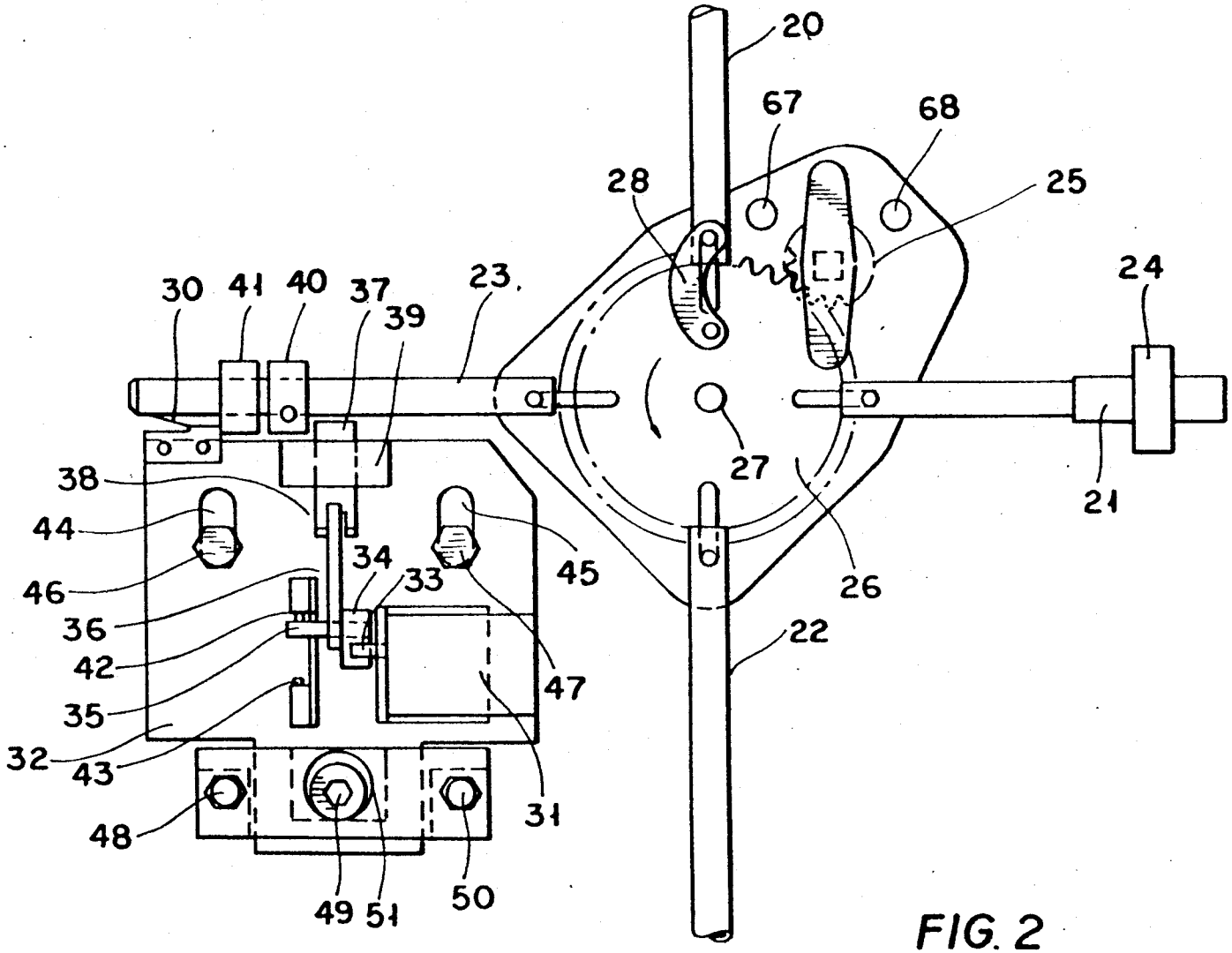
FIG. 2 is an enlarged fragmentary view of the inner side of the safe door, showing in a vertical view and partly in cross-section the locking mechanism.

As seen in FIG. 2, the inner side of the door is provided, in this embodiment, with a manually operated and an electrically operated lock. The manually operated lock is connected to the safe door through the two bores 67 and 68 through which a bolt can be passed to connect the lock to the door body. The manually operated lock comprises four bars 20, 21, 22 and 23, the first three of which cooperate with and engage seats solid with the safe body, to effect closure of the safe, only one of said seats, indicated by numeral 24, being shown in the drawing. A toothed wheel 25 is turned by operating handle 13 and will in turn rotate a larger tooth wheel 26 about the axis 27. The rotation of this latter will cause the swinging of rocking levers 28, only one of which is shown in the cross-sectional part of the drawing, which will shift the corresponding bars 20 to 23 outwardly. Thus the first three of said bars will engage the corresponding seats on the safe body, while bar 23 will actuate a microswitch 30, indicating that the manually operated lock is in the locked position.

The electrically operated lock comprises a motor 31 mounted on a plate 32, also attached to the inside of the door. On the shaft 33 of the motor is mounted an eccentric 34 which carries a pin 35 on which is mounted a rod 36. In the position shown in the drawing the motor has rotated so as to bring the rod 36 to its outermost position. In this position member 37 pivoted at 38 to the rod 36 and supported in a support 39 will reach a position, which may be called the "forward" position, in which it will not permit the manually operated lock to return to its unlocked position, because it will engage the stopper 40, mounted on rod 23. Support 41, also attached to the safe door, serves to guide rod 23 in its sliding motion. Microswitches 42 and 43 will signal whether the electrically operated mechanism is in the locked position, as shown in the drawing, or in the unlocked position, in which pin 35 will engage microswitch 43, and member 37 will be in its "rear" position, in which it is disengaged from stopper 40. The words "forward" and "rear" should not be construed as involving any limitation to the motion of the member 37 or of any other part of the mechanism, as any convenient kinematic arrangement, other than as described, may be used.

Plate 32 is mounted in such a way that it may be slid away from rod 23, in case of emergency, to free the manually operated lock, even if the electrically operated lock remains in the locked position. For this purpose grooves 44 and 45 are provided, in which bolts 46 and 47 may slide. The mechanism is held in its normal position by eccentric 49, which is located in bore 51. Bolts 48 and 50 do not apply a pressure on the plate 32. When it is desired to shift the plate 32 to free the electrically activated lock, a bore must be made in a plate which covers eccentric 49 and bore 51, not shown in the drawing, so that said eccentric 49 is reached. The eccentric 49 is then turned and the lock is then slid away from the locked position by the rotation of the said eccentric 49.

Figure 3:
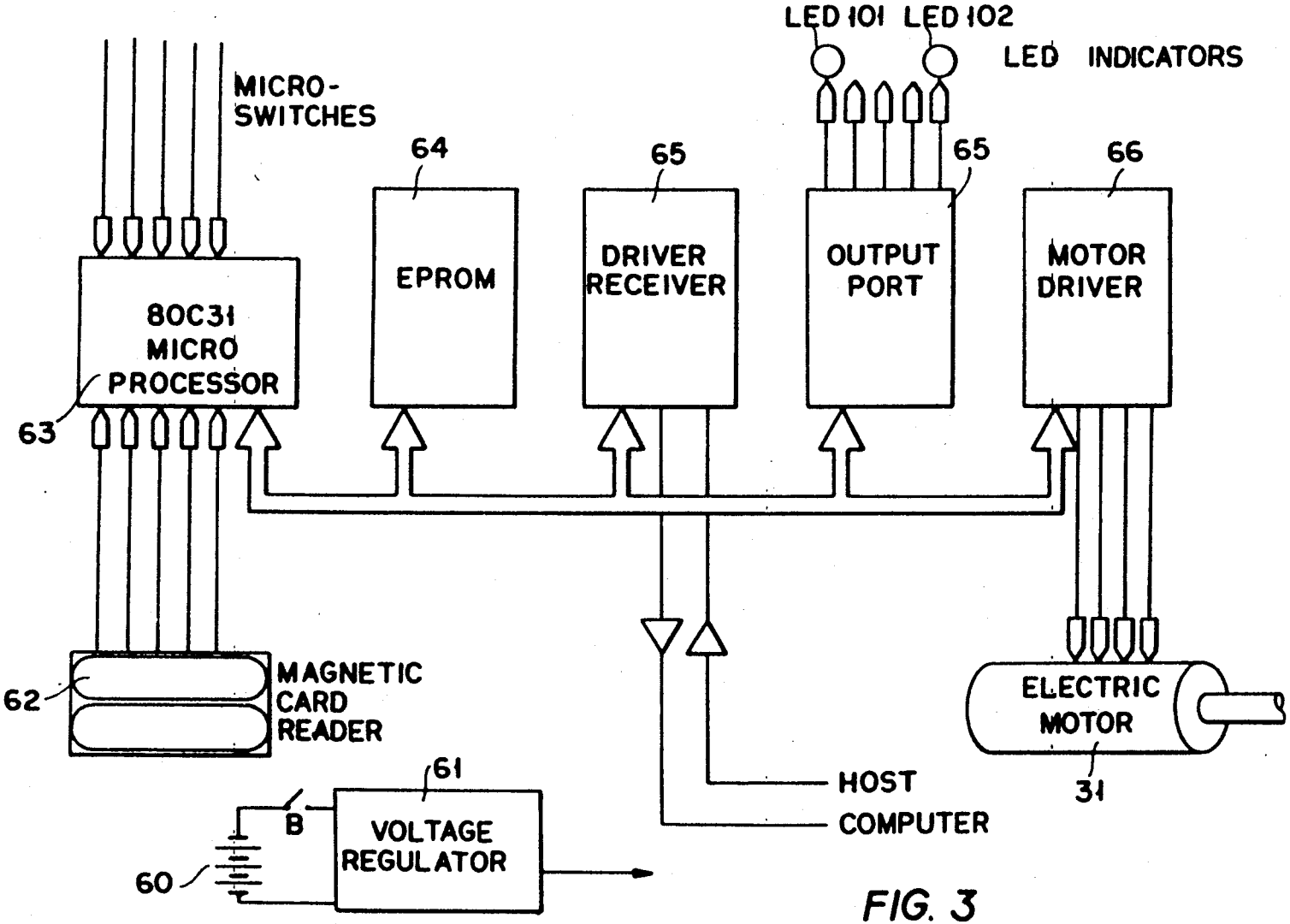
FIG. 3 is a block diagram of the electronic activating circuit and elements cooperating therewith.

FIG. 3 schematically illustrates, in the form of a block diagram, the electronic circuit controlling the safe mechanism and parts cooperating therewith. Numeral 60 designates a battery, consisting, in the embodiment described, of four elements, and delivering a voltage of 6 Volts. A voltage regulator 61 is connected thereto, to maintain the voltage normally at a value of 5 Volts, and to deliver the power to any parts of the device which require it.

62 designates a magnetic card-reader of any suitable conventional type.

Numeral 63 indicates a microprocessor, which is preferably of the type known in the art as 80C31, and which includes a CPU, a RAM, and any other accessory components, such as for instance two timers, a UART, and output and input ports. Numeral 64 designates an EPROM. Numeral 65 is a driver receiver, which connects the circuit to outside sources of information and instructions, such as a central computer. Numeral 65 is an output port. Numeral 66 a motor driver which controls the electric motor 31, already mentioned.

The operation of the device is essentially as follows. At the beginning of the operative cycle, no parts of the electronic circuit is under tension. Nevertheless, information is stored in the EPROM, as well as of course in the CPU, and this information comprises at least the code of a master card, which can be used to open the safe in case of emergency. The safe door is open. The upper part of the safe door houses a conventional key-operated electric switch shown diagrammatically in FIG. 3 as switch 103. All the timers are of course at zero. The user then inserts a key in the switch and turns the key, and thereby connects the storage batteries with the activating circuit and provides voltage for it. The user then closes the door. High power level is established for a very short time, e.g. 100 msec., and the appropriate luminous signal is given to show that the safe is locked or unlocked, whereafter the circuit goes to the so called "sleep" conditions, viz. to the low power level. This power level of course is sufficient to activate the RAM, so that the master card data may be and are moved from the ROM to the RAM.

At this time, the magnetic card-reader power is turned on, the temporary buffer in the appropriate memory segment of the RAM is filled with zeros and the card is read into said temporary buffer. If, however, this is not done or the operation is not completed within a given time, e.g. 2 seconds, the device signals an error and goes to the aforesaid "sleep" condition. In any case, as soon as the card has been read, the card reader power is turned off and the card is checked. The method of checking the card is a well known and conventional one. Since the card is supposed to contain an even number of digits and an equal number of 1 and 0, the various digits are individually read and it is checked that the number of 1 is equal to the number of 0, and then the total number of digits is also read. If these are correct and the check is therefore positive, the operation will go on as will now be described, and if the check is negative, the device signals an error, and goes to the "sleep" condition.

Assuming then that the check has been positive, the following operations depend on the condition of the safe. If the door is closed and unlocked and the battery is in good conditions, the content of the temporary buffer is moved into the card buffer, to be stored therein until further notice and as long as the RAM is under tension, and the motor is activated in the lock direction. A certain time, e.g. 2 seconds, is allowed for the motor operation, whereafter it is stopped. After a short wait of a few milliseconds to eliminate bounce the condition of the door is checked. The door should be closed and locked. If it is so, the locked condition is indicated by turning on the locked LED 101 for a short time, say 2 seconds, and then the circuit goes to the "sleep" conditions. If the door is not closed and locked, the motor is activated in the unlock direction, and stopped after a given time, say 2 seconds. An error is then indicated and the circuit goes to the "sleep" conditions.

If the door is not closed and locked, or the battery is not good, the above operations cannot take place, and the content of the temporary buffer is checked against that of the card buffer and of the master card. If the contents do not correspond the counter is incremented up to 5 and thereafter an error is signaled and an alarm is set on for a number of seconds, whereafter the circuit goes to the "sleep" conditions. If there is agreement of the temporary buffer with the card buffer or the master card, the motor is activated in the unlock direction and a short wait, say 2 seconds, occurs. If after that wait the door is not unlocked, an error is signaled and the circuit goes to the "sleep" condition. Otherwise, if the door is unlocked, the unlocked LED 102 is turned on for a short time, say 2 seconds, and then the activating circuit goes to the "sleep" condition.

At this point all the electronic and electric operations have ended, the safe is either in the locked condition and is left as such, or is in the unlocked condition and then the handle 13 can be turned to open the manual lock, and to open the safe.

As long as the same person uses the safe, the key, which connects the activating circuit to the power source, remains in its place, so that the RAM is always under tension. When a person ceases using the safe and opens it for the last time, he removes the key and leaves the safe in the initial conditions from which all the aforesaid operations started.

It is within the skill of the skilled to devise a program that will carry out all the aforesaid operations and all the accessory ones that may be desired.

It is clear from the above that the safe can be unlocked either by using the same card by which it has been locked, or by using the master card. It is also clear that the various checks described, and in particular that referring to the correctness of the card data, will prevent many malfunctions and inconveniences deriving therefrom.

It is also clear that, while the electric lock assures that the safe cannot be opened by an unauthorized person, it may be preferred to provide the mechanical lock as well.

Nevertheless, when this is not required, the device may be simplified in an obvious manner, by dispensing with the manual lock and causing the electrical lock, or any other part mechanically connected with an eccentric actuated by the electric motor, to engage a seat on the safe body and therefore directly provide the mechanical engagement of the safe door with the safe body. Such a device is illustrated in FIGS. 4 to 8, and is provided, in this embodiment, with a particularly safe emergency opening mechanism. The electric operations hereinbefore described apply of course to devices not including a manual lock as well.

Figure 4:
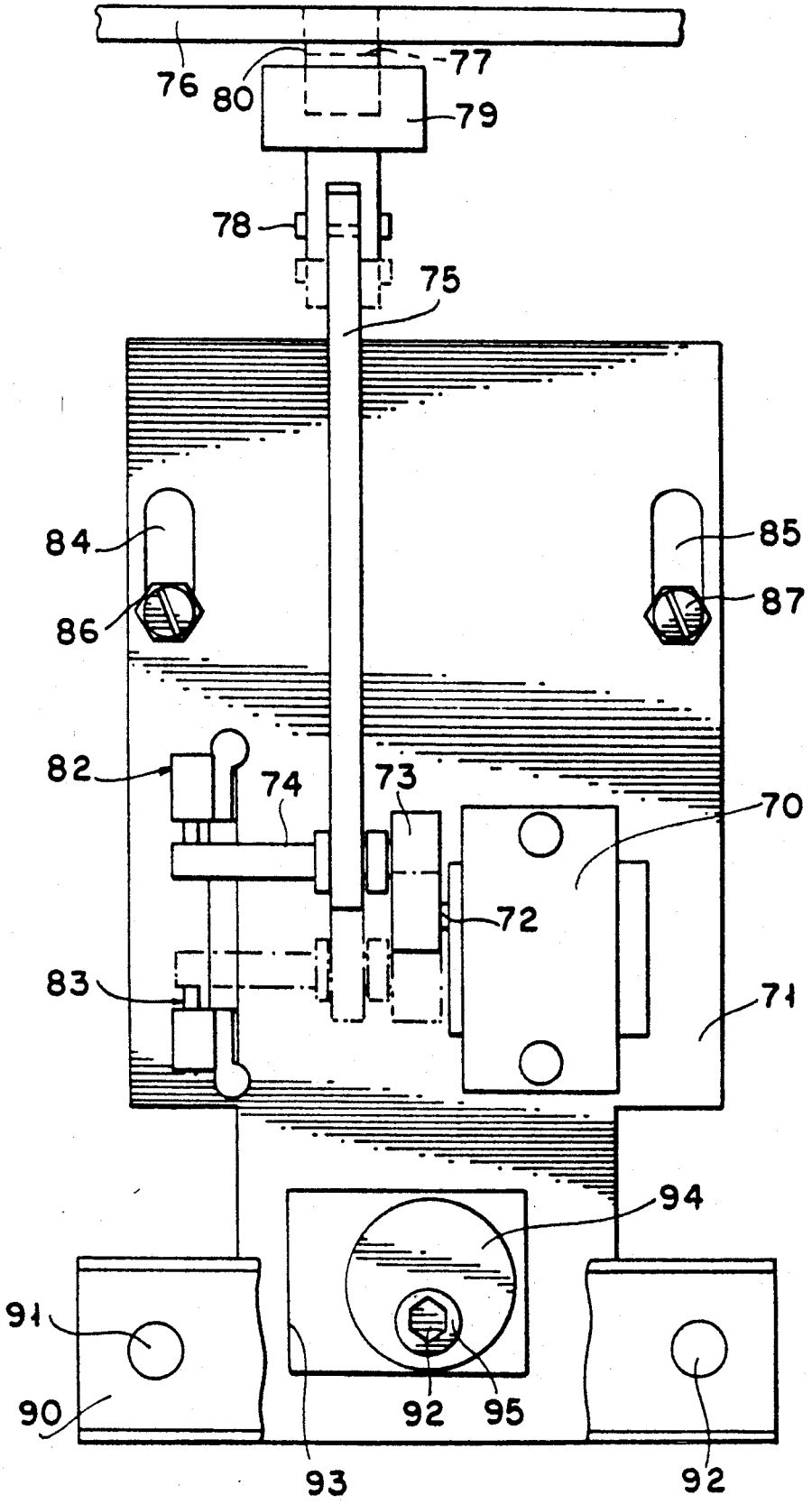
FIG. 4 is a schematic view of an electric lock according to another embodiment of the invention, in its normal locked and unlocked positions.

With reference to FIG. 4, the electric lock is attached to the inside of the safe door and is shown, similarly to FIG. 2, on a plane parallel to the safe door, normally a vertical plane, as it would be seen from the inside of the safe. The door itself is not shown. Said lock comprises a motor 70 mounted on a base plate 71 attached to the inside of the safe door. On the shaft 72 of the motor is mounted an eccentric 73 which carries a pin 74 on which is pivotally mounted a rod 75. In the locking or operative position of the lock shown in the drawing, the rod is in what will be called its "forward" position. In this position a member 77, herein illustrated as a tongue, but which may have any convenient structure, pivoted at 78 to the rod 75 and supported in a support 79, will engage a seat 80, provided in a part 76 of the safe body, whereby to lock the door on which base plate 71 is fixed, to the safe body and prevent opening of the safe. Microswitches 82 and 83 will signal whether the electric lock is in the operative or locking disposition, or in the unlocking disposition. In the first disposition the pin 74 engages the microswitch 82 and in the second disposition it engages the microswitch 83. Base plate 71 is provided with grooves 84 and 85, in which bolts 86 and 87 may slide, and said bolts attach said plate and therefore the lock to the safe door.

The electric lock of FIG. 4 is brought to the inoperative or unlocking disposition by a rotation of the motor 70 and a consequent withdrawal of rod 75 and tongue 77 to a rear position, in which said tongue does no longer engage the seat 80 and the safe door may be opened. The unlocking position of the said parts is shown in broken lines. It will be obvious that, while tongue 77 or equivalent member, moves from one position to the other by a sliding displacement, any other type of displacement could be used.

Figure 6:
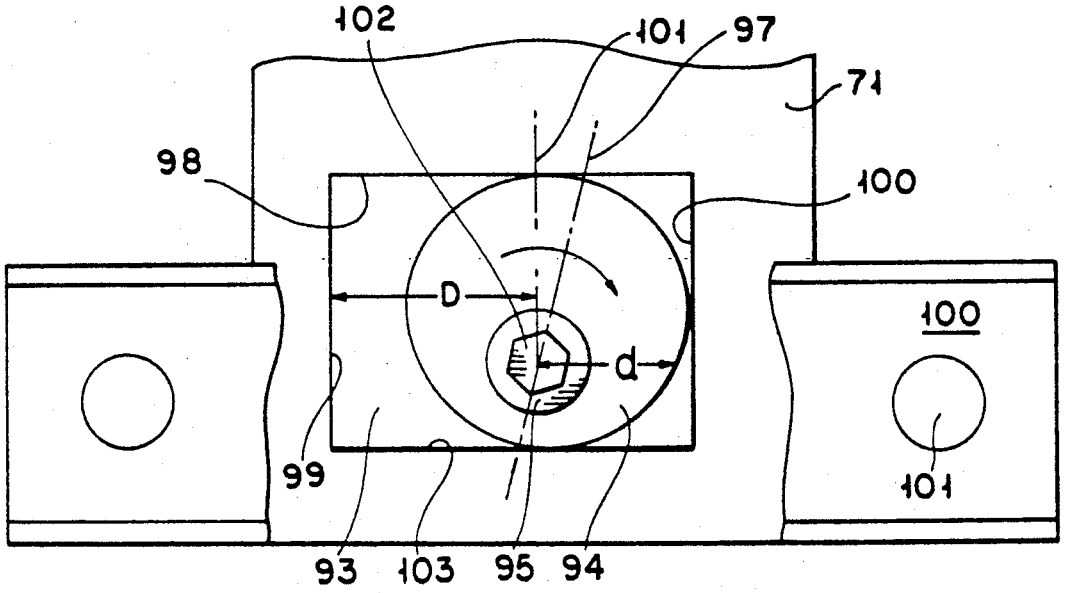
FIG. 6 is a detail, at an enlarged scale, of a portion of the lock of FIG. 4.
Figure 7:
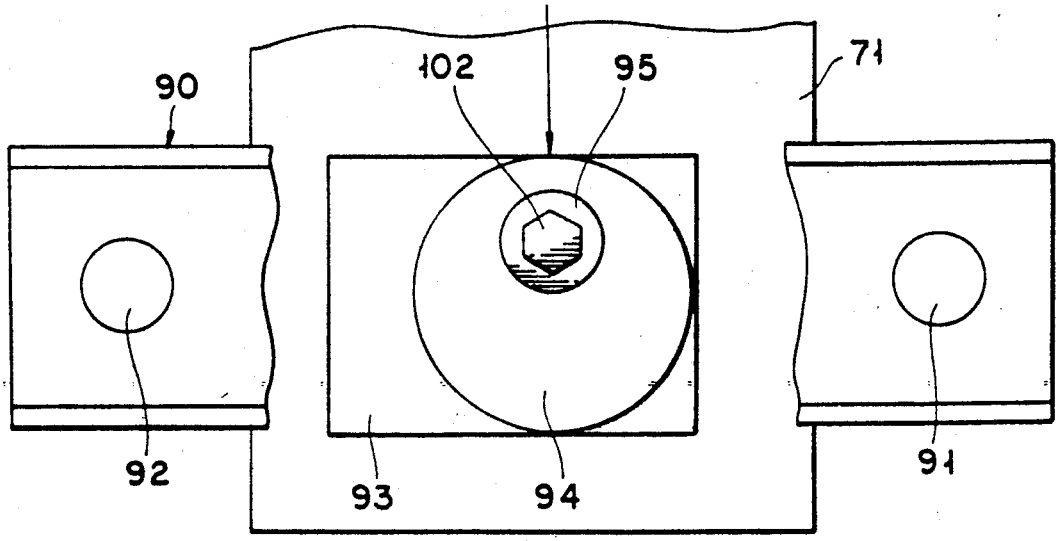
FIG. 7 is a view of the detail, at enlarged scale, of a portion of FIG. 5.
Figure 8:
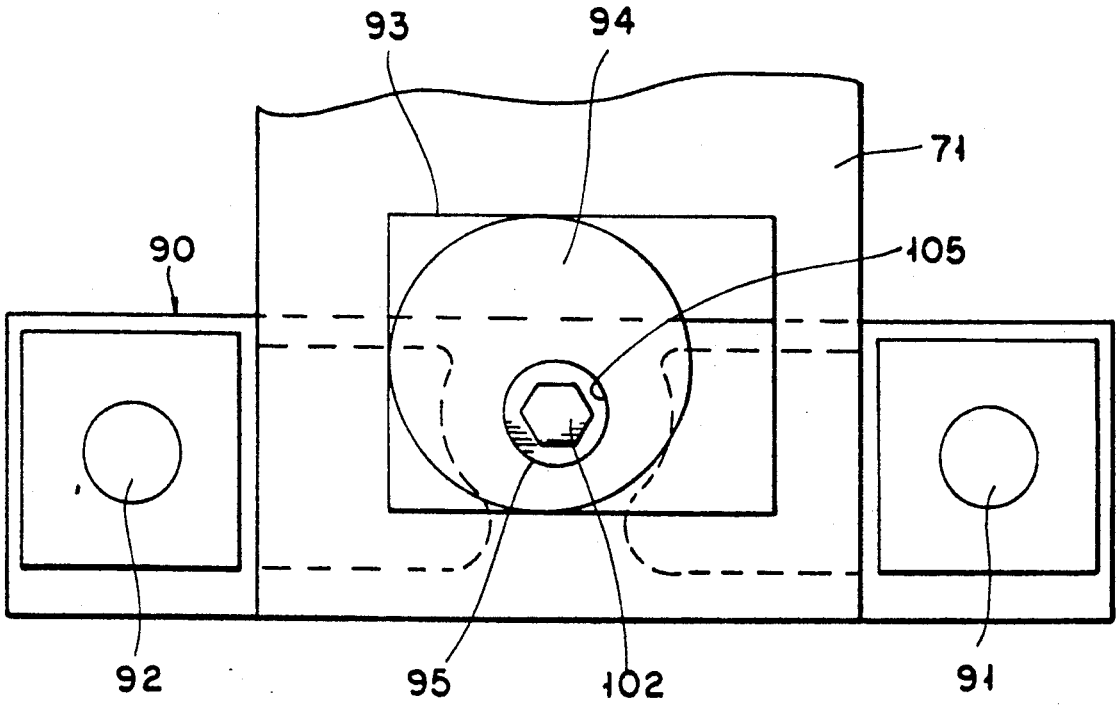
FIG. 8 is a view of the detail of FIG. 6, seen from the opposite side.

As better seen in FIGS. 6 to 8, which show at an enlarged scale the bottom portion of the lock of FIG. 4 (seen in FIG. 8 from the opposite side, viz. from the outside of the safe, with the door removed) a support 90 is further provided and is rigidly attached, such as by means of bolts not shown in the drawing, passing through bores 91 and 92, to the safe door. Base plate 71 is provided with an essentially rectangular opening 93. An eccentric 94 is provided with a shank 95 (shown in FIG. 4) rotatable in a corresponding bore 105 (shown in FIG. 8) of support 90. The base plate 71 and the eccentric 94 with its shank 95 are held against displacement with respect to the support 90 and disengagement therefrom in the direction of the shank 95 by the safe door on one side and by a cover plate or other suitable means, not shown.

When the mechanism is in the condition shown in FIG. 4, viz., a normal, operative condition, in which it may be actuated to close or open the safe, as the case may be, by activating motor 70, eccentric 94 is in the position of FIG. 6, that is, as it is seen, slightly past its dead center position, wherein the largest radius of the eccentric, lying on the line 97, would contact the side 98 of the opening 93. As it is seen, the axis of shank 95 is spaced from the side 99 of opening 93 by a distance that is greater than said largest radius of the eccentric, and is spaced from the side 100, opposite to the side 99, by a distance that is substantially smaller than said largest radius, while the distance between the two other sides 98 and 103 is essentially equal to the sum of the largest and the smallest radius. As a result, eccentric 94 bears, in the position of FIG. 6, against the said side 100 and is prevented thereby from further rotating in the direction of the arrow. On the other hand, any rearwardly pressure exerted by base plate 71 on eccentric 94, for any reason whatsoever, will be directed parallel to line 101 and will tend to cause said eccentric 94 to rotate in the direction of the arrow, which it cannot do. Therefore, the base plate 71 and with it the electric lock are stable in the position of FIG. 6 and cannot be displaced from it accidentally.

Figure 5:
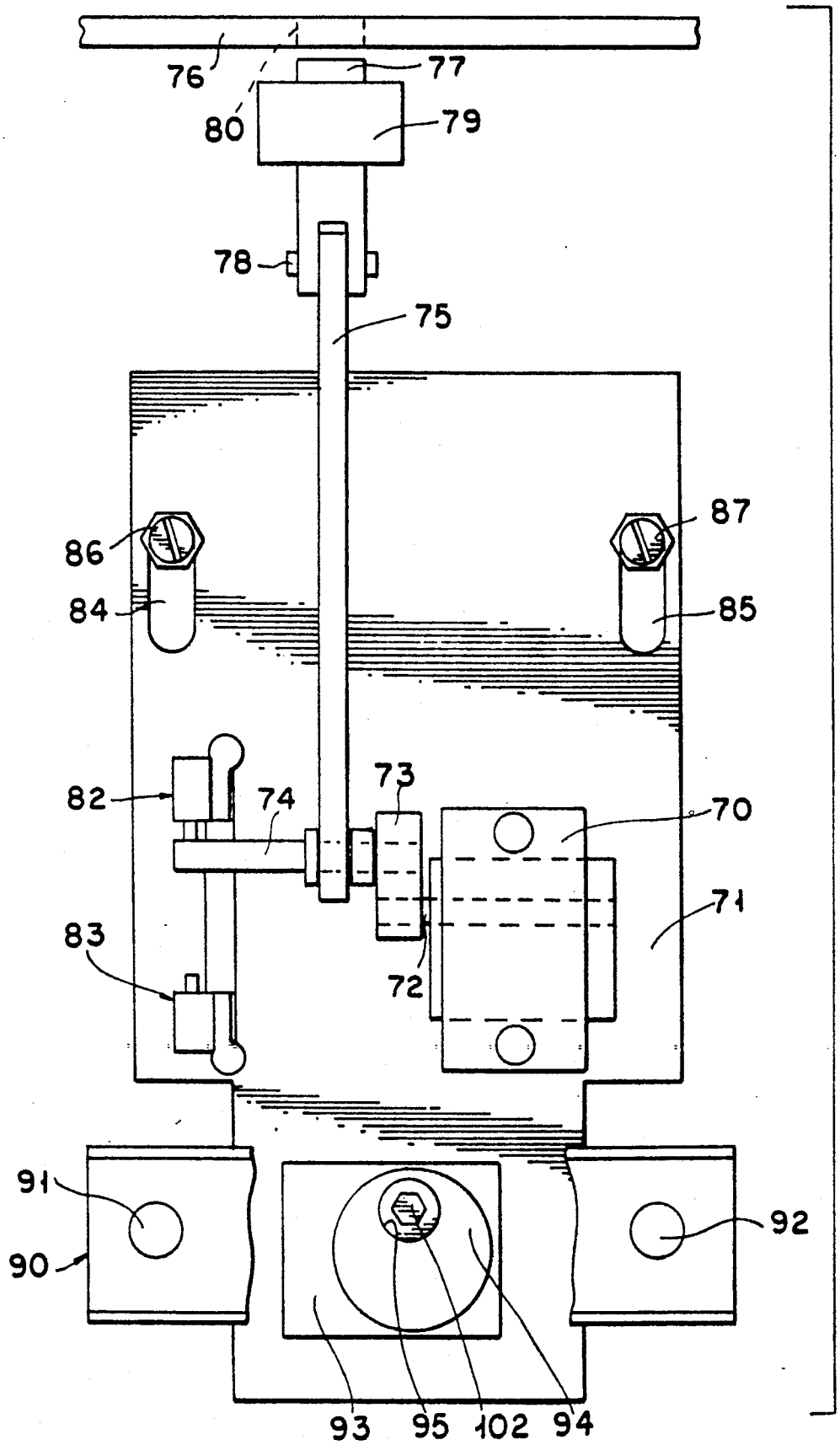
FIG. 5 shows the same lock after the emergency unlocking mechanism has been operated to open the safe.

Now, if the safe opening mechanism fails for any reason and it is desired to open the safe, the safe door will be perforated at the position in which shank 95, as seen in FIG. 8, is located. This will uncover a bore 105 in the eccentric 94 (FIG. 8) and a coaxial polygonal opening 102 in said shank, and by inserting a matching key in said polygonal opening, the shank 95 and the eccentric 94 can be rotated in the direction opposite to the arrow in FIG. 6, viz., in a counterclockwise direction looking at FIG. 6 and a clockwise direction, looking at FIG. 8. This will initially cause the base plate 71 to shift very slightly forward, viz., to further urge tongue 77 into seat 80, and in order to permit this, a slight play must be provided between the end of said tongue and the bottom of said seat, if said seat is not open. Thereafter, continued rotation of eccentric 94 will cause successively larger radii thereof to come into contact with side 103 of opening 99 and said base plate will be displaced rearwardly, viz., in the direction of the arrow in FIG. 7, until the eccentric comes to dead center with respect to side 103, viz., contacts said side with its largest radius, and the base plate is in its rearmost position. In this position tongue 77 will have become disengaged with seat 80, although said tongue has not been actuated by the kinematism driven by motor 70 and has remained in the forward, locking position with respect to base plate 71. The resulting condition of the lock is illustrated in FIGS. 5 and 7. Opposite rotation of eccentric 94 will bring the base plate and the electric lock back to the position of FIGS. 4 and 6, whenever the failure in the actuating mechanism has been repaired.

It will also be clear from FIG. 3 that other operations, depending on information and/or instructions received from outer sources through the driver-receiver 65, can be performed by the safe mechanism activating circuit.

The motor driver 66 has not been described in its inner structure, since it may be conventional and comprise the usual electric and electronic elements required to cause the electric motor to turn in one or the other direction and to stop whenever desired, responsive to the signal received from the microprocessor. The microprocessor itself is a component which can be purchased on the market or substituted with equivalent electronic devices, also obtainable on the market. The electronic card-reader likewise is a conventional device.

It is seen that the safe and the safe operating mechanism described fully attain the purposes of the invention, set forth in the introductory part of this description. It is also understood that many modifications and adaptations can be made therein, without departing from the spirit of the invention and from the scope of the appended claims.

We claim:

1. A magnetic card-operated safe comprising:

a body with a structural element;

a door;

a locking mechanism for locking said door;

a support fixed to said structural element with a base plate, on which the locking mechanism is mounted and which is slidably mounted on said structural element for limited rectilinear displacement between a forward and a rear position of the locking mechanism, an eccentric rotatably mounted on said support and engaging an opening in said base plate, whereby rotation of said eccentric will cause said rectilinear displacement of said base plate, said eccentric being so mounted that it may freely rotate whereby to displace said base plate from the rear to the forward position;

a source of power including a battery;

an electric motor for operating said locking mechanism;

a magnetic card reader for reading data stored in the magnetic card used for operating the safe;

permanent memory means for permanently storing information;

volatile memory menas for storing data as long, and only as long, as electric tension is applied thereto;

means for transferring the data read by the magnetic card reader from said magnetic card to a segment of said volatile memory means when no such data are registered therein and for comparing said read data with the data registered therein, when there are such registered data, and with the information stored in said permanent memory means;

electronic circuit means for operating said motor, said magnetic card reader, said permanent memory means, said volatile memory means and said data transferring and comparing means;

switch means, operable when said safe door is open to selectively connect and disconnect said power source to said electronic circuit means;

means for changing the power drawn from said power source, when it is so operatively connected to said electronic circuit means, between at least one high level sufficient to actuate said electric motor and at least one low level sufficient to prevent erasure of the data stored in said volatile memory; and control means for actuating said electric motor to activate said locking mechanism to lock or unlock said safe door, when said magnetic card is read by said magnetic card reader, only if the data read by this latter corresponds to those registered in said volatile memory means or to information stored in said permanent memory means.

2. A safe according to claim 1, wherein the permanent memory means for permanently storing information comprise at least one EPROM.

3. A safe according to claim 1, wherein control means comprises an 80C31 microprocessor.

4. A safe according to claim 1, wherein said locking mechanism has a locked and an unlocked position, said mechanism being further provided with microswitches for signalling the locked or unlocked position of the locking mechanism.

5. A safe according to claim 1, comprising optical indicator means to signal errors and to signal whether safe door is locked or unlocked.

6. A safe according to claim 1, comprising driver-receiver means for connecting it with outside sources of information and instructions.

7. A safe according to claim 1, wherein the structural element of the safe is the safe door, and the locking mechanism is provided with a locking member engaging a seat in the safe, when the lock is in its operative, locking disposition.

8. A safe according to claim 1, wherein the base plate is provided with an essentially rectangular opening and said eccentric is mounted for rotation about an axis, the distance of which from one of the sides of said rectangular opening, parallel to the direction of the rectilinear displacement of said base plate, is at least as great as the largest radius of said eccentric, and the distance of which from the opposite side of said opening is substantially less than said longest radius, the distance between the two remaining sides of said opening being essentially equal to the sum of the largest and the smallest radii of said eccentric.

9. A safe according to claim 1, wherein said volatile memory means comprise at least one temporary buffer location and one card buffer location, said mechanism further comprising means for transferring the data read by said magnetic card reader to said temporary buffer location, checking their correctness, and transferring them, if correct, to said card buffer location.

10. A safe according to claim 1, wherein said eccentric may rotate by a small angle, after said base plate has reached said forward position, in the direction in which it has rotated to displace said base plate from said rear to said forward position, until said eccentric bears against a portion of said base plate.

* * * * *